US008220380B2

(12) United States Patent
Andres et al.

(10) Patent No.: US 8,220,380 B2
(45) Date of Patent: Jul. 17, 2012

(54) HYDRAULIC UNIT

(75) Inventors: Günter Andres, Much (DE); Ulf Sittig, Nümbrecht (DE); Bernd Thelen, Much (DE); Paul-Heinz Wagner, Much (DE)

(73) Assignee: Wagner Vermögensverwaltungs-GmbH & Co. KG, Much (DE)

( * ) Notice: Subject to any disclaimer, the term of this patent is extended or adjusted under 35 U.S.C. 154(b) by 955 days.

(21) Appl. No.: 11/887,639

(22) PCT Filed: Mar. 23, 2006

(86) PCT No.: PCT/EP2006/061014

§ 371 (c)(1),
(2), (4) Date: Aug. 4, 2008

(87) PCT Pub. No.: WO2006/103199

PCT Pub. Date: Oct. 5, 2006

(65) Prior Publication Data

US 2008/0302097 A1 Dec. 11, 2008

(30) Foreign Application Priority Data

Apr. 1, 2005 (DE) ..... 20 2005 005 165

(51) Int. Cl.
*F01B 1/06* (2006.01)
*F16D 31/02* (2006.01)
*F04B 35/04* (2006.01)

(52) U.S. Cl. ..... 92/72; 91/491; 60/456

(58) Field of Classification Search ..... 60/456; 91/491; 92/72, 71; 417/271, 273, 410.3, 417/423.3

See application file for complete search history.

(56) References Cited

U.S. PATENT DOCUMENTS

| | | | | |
|---|---|---|---|---|
| 4,568,253 | A * | 2/1986 | Wood | 417/410.3 |
| 4,626,178 | A * | 12/1986 | Terumoto | 417/410.3 |
| 5,073,092 | A | 12/1991 | Gebauer et al. | |
| 5,741,124 | A * | 4/1998 | Mazzucato et al. | 417/271 |
| 6,078,118 | A * | 6/2000 | Reinartz et al. | 417/271 |
| 6,524,084 | B2 * | 2/2003 | Neumair | 417/271 |
| 2005/0069434 | A1 * | 3/2005 | Tani | 417/423.3 |
| 2005/0175479 | A1 * | 8/2005 | Gandrud et al. | 417/410.3 |

FOREIGN PATENT DOCUMENTS

| | | | |
|---|---|---|---|
| DE | 295 19 941 | U1 | 4/1997 |
| DE | 298 02 441 | U1 | 5/1998 |
| EP | 0 940 578 | B1 | 5/2004 |
| FR | 2 463 298 | A | 2/1981 |
| WO | WO 03/087576 | A1 | 10/2003 |

OTHER PUBLICATIONS

European Patent Application No. 11 17 3668—Extended European Search Report dated Oct. 11, 2011.

* cited by examiner

*Primary Examiner* — Michael Leslie
(74) *Attorney, Agent, or Firm* — Miles & Stockbridge P.C.; David R. Schaffer, Esq.

(57) ABSTRACT

The invention relates to a hydraulic group comprising a reservoir (28) for oil, in which a multiple piston pump (60) is arranged. The individual pumps (61) are cyclically driven by an eccentric ring (29). In order to ensure a permanent immersion of the individual pumps in the reservoir (28), an auxiliary reservoir (47) providing oil for refilling the reservoir (28) is arranged above the reservoir. The auxiliary reservoir (47) is connected to an additional tank (45) by means of a connection line (48).

20 Claims, 4 Drawing Sheets

HYDRAULIC UNIT

BACKGROUND OF THE INVENTION

The invention relates to a hydraulic unit comprising an oil-containing reservoir which includes a motor and a pump driven by said motor.

A hydraulic unit comprises a pump acting as a pressure generator, said pump taking in oil from a reservoir and supplying said oil to a consumer. A return line extends from the consumer back to the reservoir. Hydraulic units are known which comprise a motor configured as a submersible motor arranged in the reservoir and submerged in the hydraulic fluid. The heat generated in the motor is discharged via the hydraulic oil.

BACKGROUND OF THE INVENTION

It is an object of the invention to provide a hydraulic unit which is capable of supplying defined variable volume flows without the risk of air aspiration.

The hydraulic unit comprises a multiple piston pump composed of individual pumps arranged in a specific array, wherein the reservoir has connected therewith an auxiliary reservoir at least partly filled with oil for filling up the reservoir when oil has been withdrawn by the multiple piston pump, thus ensuring a complete submersion of the multiple piston pump.

A multiple piston pump is a positive displacement pump supplying a continuous volume flow which can be varied by changing the rotational speed. If the motor is a synchronous motor, the magnitude of the volume flow is adapted to be varied in accordance with the load of the respective power consumer using a corresponding motor control. Use of a multiple piston pump, where the individual pumps are arranged in a specific array in the reservoir, involves the risk that, when the oil level decreases, the intake opening of at least one individual pump is temporarily not submerged and takes in air. This must be prevented in view of obtaining a defined volume flow.

According to the invention, the auxiliary reservoir makes sure that the reservoir is filled up again when a large quantity of oil has been withdrawn from the reservoir, such that a complete submersion of the multiple piston pump is ensured.

The hydraulic unit according to the invention is in particular suitable in cases where consumers with different consumption capabilities are connected. If a consumer is a hydraulic power wrench for turning screws and bolts, the load to be overcome by the hydraulic pressure is normally high such that the delivery rate and/or the volume flow are small. A different scenario is provided if a connected consumer is a piston-cylinder unit, for example, whose large-volume cylinder includes a piston which is moved against a small load. Here, a resultant rapid piston movement produces a large volume flow. The large volume flow results in a change of the oil level in the reservoir, wherein the upper individual pumps are possibly not submerged for a short time. Such a condition is prevented by the auxiliary reservoir.

The invention is advantageously applicable to a hydraulic unit comprising a reservoir with a cross section where the width of the reservoir narrows towards the upper end. Such a cross section is offered e.g. by a reservoir having a substantially round cross section. Such a reservoir allows a space-saving placement of the motor and the pump. This configuration offers a hydraulic unit with a small volume and a low weight such that the hydraulic unit can be designed as a portable unit. On the other hand, without an auxiliary reservoir there would be the risk that due to the cross section narrowing in upward direction, the upper region having a small volume would rapidly be emptied and remain so when a large quantity of oil is withdrawn.

The auxiliary reservoir may be arranged on top of the reservoir either as an additional container or as a cavity which is permanently connected with the reservoir, but has a larger width than the upper end of the reservoir.

According to a preferred aspect of the invention, the auxiliary reservoir is hermetically sealed above the oil level, and a connecting line connects the auxiliary reservoir with a vented additional tank at a location below the oil level. Here, the auxiliary reservoir and the additional tank define a communicating system. The atmospheric pressure causes oil to be fed from the vented tank to the auxiliary reservoir when oil is withdrawn from the auxiliary reservoir to flow to the reservoir. The additional tank increases the volume of the auxiliary reservoir, but, on the other hand, is spatially separated from the auxiliary reservoir. The auxiliary reservoir is arranged above the reservoir, while the additional tank may be located below the reservoir. The additional tank may thus define a base for the housing of the reservoir.

Further, a plurality of additional tanks of different sizes may be provided which are optionally adapted to be attached to the housing. In this manner, the user can select the size of the respective additional tank.

Alternatively, the auxiliary reservoir can be used without any additional tank. In this case, a ventilation opening must be provided above the maximum oil level such that the withdrawal of oil from the reservoir is not affected.

BRIEF DESCRIPTION OF THE SEVERAL VIEWS OF THE DRAWINGS

An embodiment of the invention will now be described in greater detail with reference to the drawings in which.

DETAILED DESCRIPTION OF THE INVENTION

Figure 1:
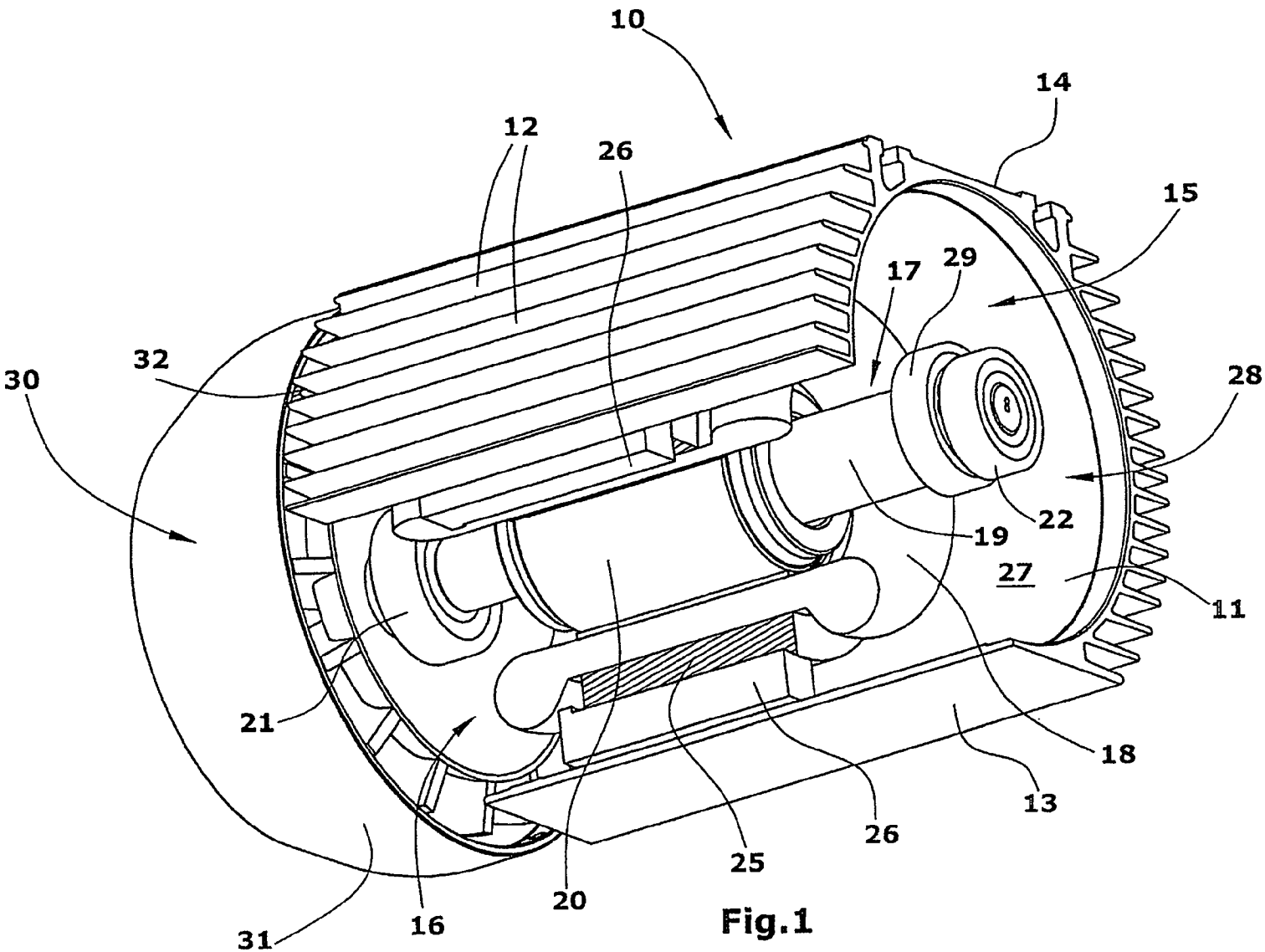
FIG. 1 shows a schematic perspective representation of the hydraulic unit with a portion cut away.

As shown in FIG. 1, the hydraulic unit comprises a housing 10 which is a conventional motor housing of an electric motor. The housing 10 has a cylindrical inner wall 11 and comprises on its outside numerous longitudinal ribs 12 defining cooling ribs. The housing 10 is configured as a profile body composed of an extruded profile. At one location on its circumference the housing 10 is provided with a longitudinal mounting plate 13 attached thereto, and diametrically opposed a fastening profile 14 for attaching components to the housing is located.

The housing 10 comprises an electric motor 15. Said electric motor 15 includes a stator 16 and a rotor 17. The motor is a permanently excited synchronous motor whose stator comprises a rotating field-generating stator winding 18. The rotor 17 includes a motor shaft 19 and permanent magnets 20 fastened thereto. The motor shaft 19 is supported in bearings 21,22 located in the front walls (not shown) of the housing 10.

The stator winding 18 is enclosed by a hoop 25 defining a closed ring and surrounding the stator winding. At the cylindrical inner wall 11 of the housing 10 spacers 26 are fastened which extend radially inwardly and center the hoop 25 in the housing. In this manner, the stator 16 is centered in the housing. The spacers 26 are bars extending in the longitudinal direction of the housing. At least three such bars are provided, but in the present embodiment 4 bars are arranged. The spacers 26 are shorter than the axial length of a space 27 such that they do not impair the circulation of hydraulic oil in the space 27.

The spacers 26 provide an annular space 27 between the stator 16 and the inner surface 11 of the housing, said annular space 27 constituting the major portion of a reservoir 28. The reservoir is defined by the housing 10. The stator 16 and the rotor 17 are submerged in hydraulic fluid.

The motor shaft 19 of the motor 15 comprises an eccentric ring 29 driving a pump. The pump is a multiple piston pump composed of a plurality of individual pumps arranged in a star-like array about the motor shaft 19, the pistons of said pumps being driven by the eccentric ring 29 which is permanently connected in an eccentric manner with the motor shaft. Each individual pump takes in oil from the reservoir via a non-return valve, and supplies said oil to the pump outlet via another non-return valve. The multiple piston pump is a volumetric pump.

At the end of the housing 10 opposite the pump, a fan 30 is located which comprises a housing 31 radially projecting beyond the housing 10. In the housing 31 a fan wheel rotates which produces an airflow 32 along the ribs 12. The fan wheel is connected with the motor shaft 19 and is driven by said shaft. An effective heat dissipation results in a good cooling effect. Since the hydraulic unit heats up only to a small extent, its efficiency is increased. Omission of a separate motor housing allows for a compact design and a low weight of the hydraulic unit.

Figure 2:
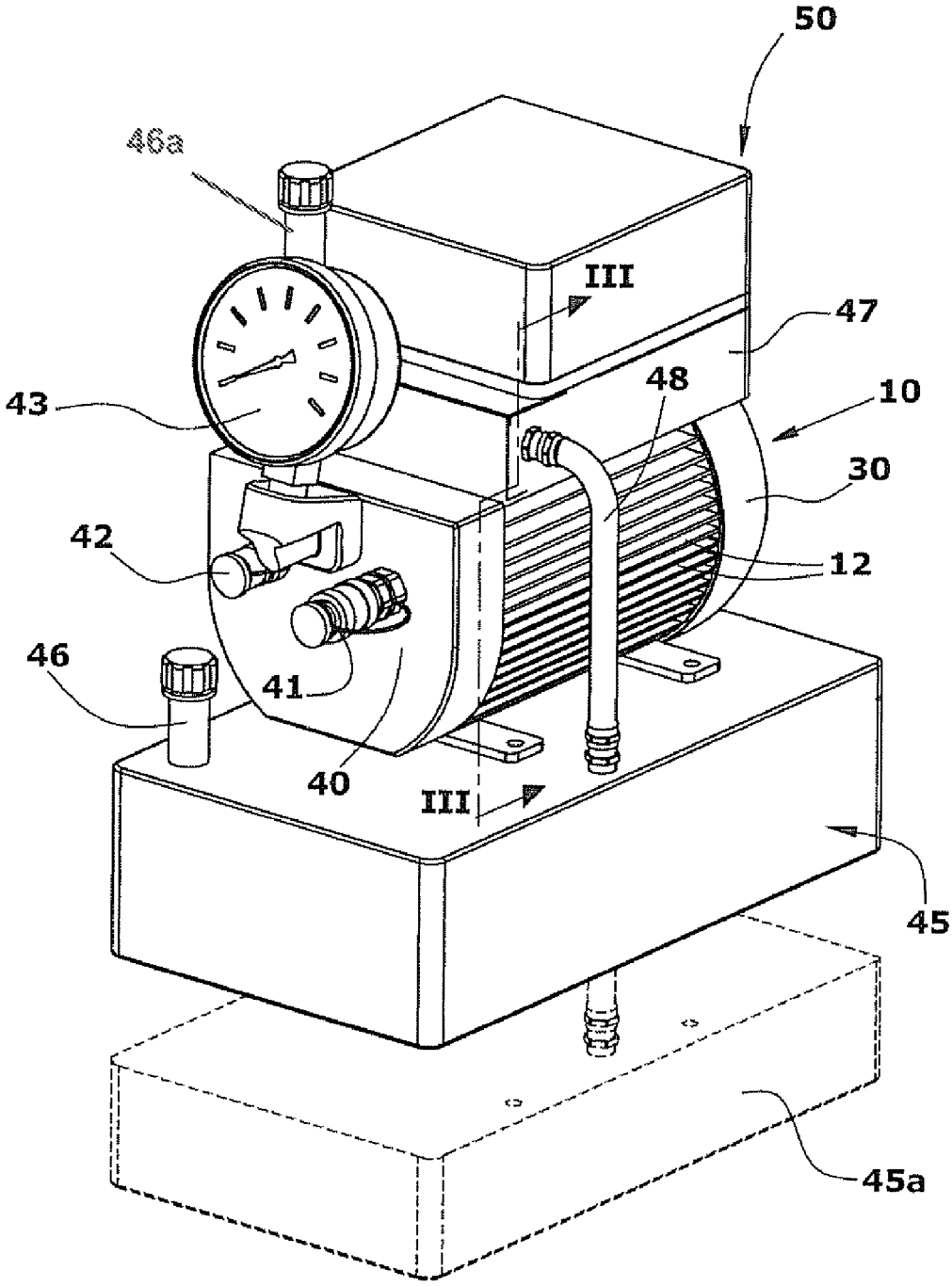
FIG. 2 shows a perspective view of the overall hydraulic unit including the auxiliary reservoir and the additional tank.

FIG. 2 shows the overall hydraulic unit. In the Figure, the housing 10 comprising the longitudinal ribs 12 is represented. At one end, the fan 30 is located which produces an air flow along the outside of the housing. At the opposite end of the housing, a pump portion 40 having a pressure connector 41 and a return port 42 on the front side is arranged. Further, a pressure gauge 43 indicating the pressure is disposed at the same end.

Below the housing 10 of the reservoir an additional tank 45 is arranged which is defined by a closed box provided with a stub 46 for venting and filing in hydraulic oil. Optionally, differently sized additional tanks 45*a* may be positioned beneath and connected to additional tank 45.

On the upper side of the housing, an auxiliary reservoir 47 is disposed which is connected with the additional tank 45 via a connecting line 48. On top of the auxiliary reservoir a motor control unit 50 is accommodated in a housing. Said motor control unit 50 is connected with the electric motor 15 via electric lines (not shown).

The pressure at the pressure connector 41 is detected by a pressure sensor (not shown). This pressure is a measure of the load of the connected consumer. The motor control 50 controls the electric motor 15 in accordance with the pressure value such that at a higher pressure the rotational speed of the motor is reduced. When the pressure decreases, the motor rotational speed increases. In this manner, the power input of the motor substantially remains constant and to a large extent independent of the respective load condition of the consumer.

Figure 3:
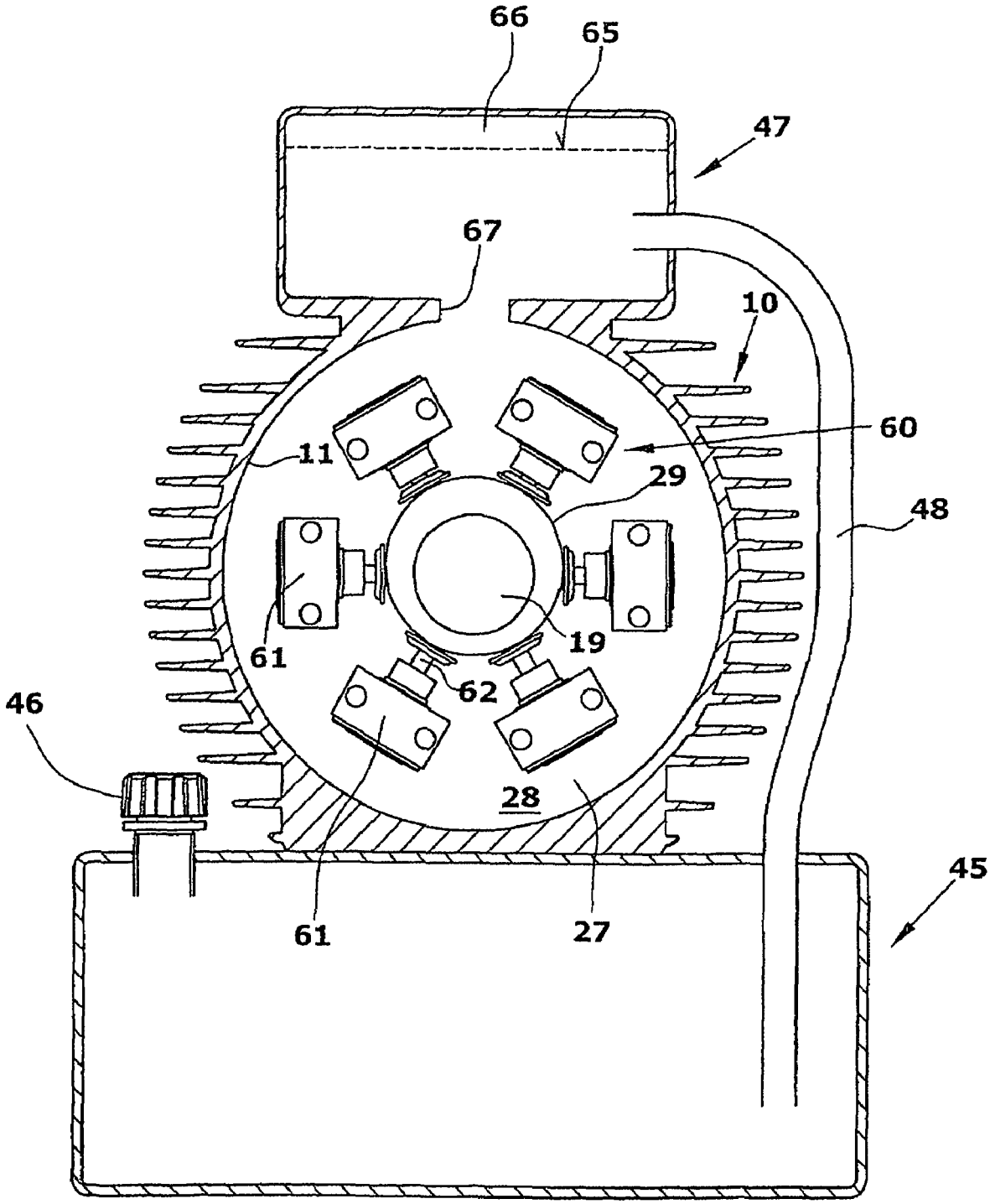
FIG. 3 shows a sectional view along line III-III of FIG. 2.

FIG. 3 shows a schematic representation of a multiple piston pump 60 arranged in the space 27 and comprising a plurality of individual pumps 61 disposed in a star-shaped array. Each individual pump 61 is a piston pump whose piston rod 62 is pressed against the circumference of the eccentric ring 29 by a spring (not shown). The piston rods 62 are cyclically actuated by the eccentric ring 29. Each individual pump 61 comprises an inlet and an outlet (not shown). The outlets are connected with each other and extend to the pressure connector 41. The inlets are openings through which oil from the reservoir 28 is taken in and fed to the individual pump. The oil, which is supplied to the consumer connected with the hydraulic unit, is withdrawn from the reservoir 28. Since the housing 10 has a round shape, withdrawal of oil results in a rapid level drop. Consequently, the inlets of the upper individual pumps 61 are possibly no longer submerged. This condition is prevented by the auxiliary reservoir 47.

As shown in FIG. 3, the auxiliary reservoir 47 has a width exceeding that of the upper end of the reservoir 28. Said reservoir 47 is filled with oil up to a level 65. Above the level 65, the auxiliary reservoir 47 is hermetically sealed such that a trapped air cushion 66 is defined. The lower end of the auxiliary reservoir 47 is connected with the space 27 via a passage 67. The auxiliary reservoir 47 thus provides an unthrottled amount of oil for refilling the reservoir 28.

The connecting line 48 connects the additional tank 45 with the auxiliary reservoir 47. Said connecting line 48 extends into the auxiliary reservoir at a location below the level 65. In the additional tank 45 the connecting line is configured as a submerged tube which ends directly above the bottom. When a negative pressure is generated by the multiple piston pump 60 in the auxiliary reservoir 47, oil from the additional tank 45 is supplied in upward direction through the connecting line 48. This supply in upward direction is caused by the atmospheric pressure entering into the additional tank through the stub 46. In this manner, a very large amount of oil for refilling the reservoir 28 is provided.

Alternatively, the auxiliary reservoir 47 can be used without the additional tank 45. In this case, the auxiliary reservoir must be vented, which can be done by including an optional stub 46*a* for venting and filling of hydraulic oil, which has a ventilation opening located above the oil level (65) in the auxiliary reservoir 47.

Figure 4:
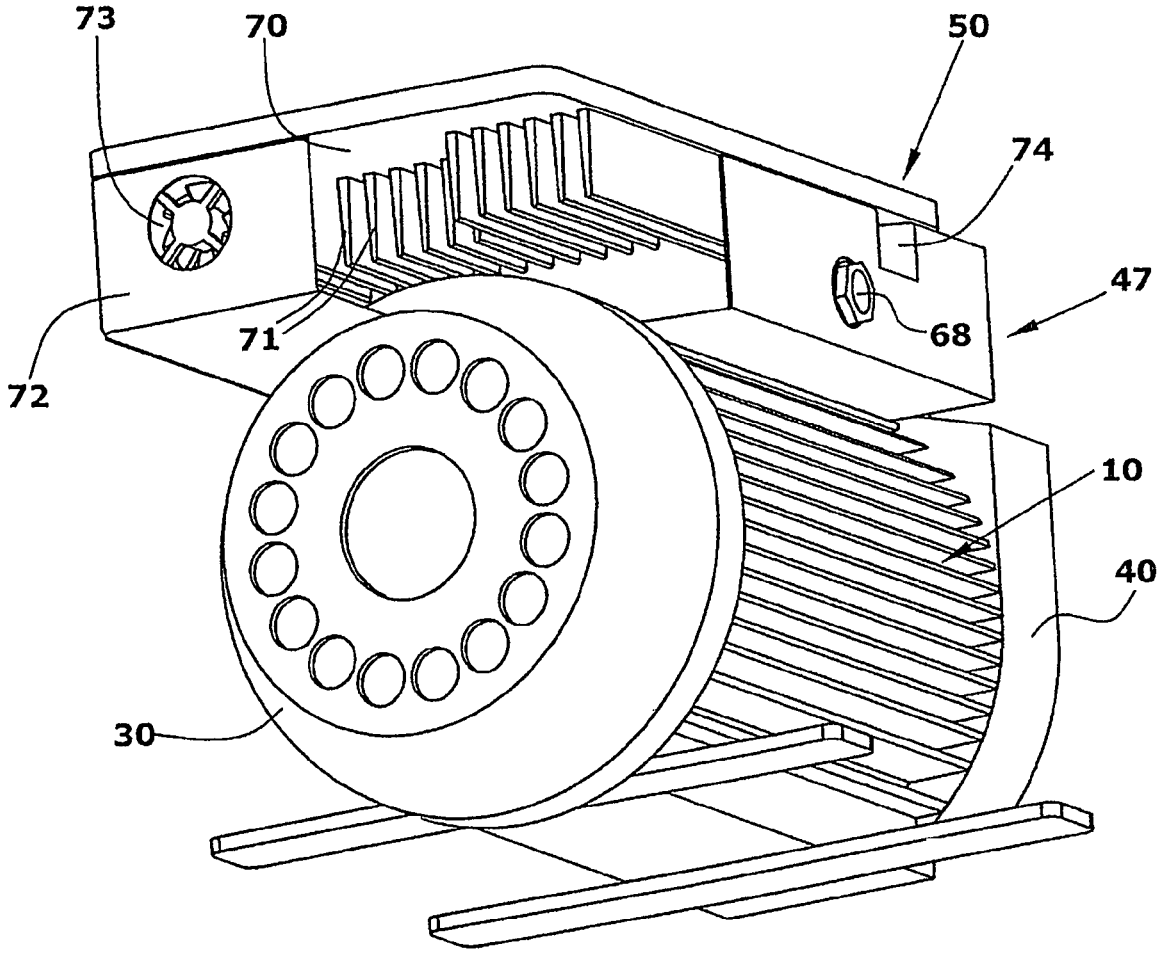
FIG. 4 shows a perspective rear view of the hydraulic unit.

FIG. 4 shows that the auxiliary reservoir 47 is provided with an inspection glass 68 through which the level can be checked for determining whether the auxiliary reservoir operates properly.

As shown in FIG. 4, a motor control unit 50 is arranged on top of the auxiliary reservoir 47. Said motor control unit 50 includes the required electrical components not shown here. The motor control unit 50 comprises on its lower side a plate 70 provided with numerous longitudinal cooling ribs 71. The cooling ribs 71 cover that portion of the housing 10 which is not covered by the auxiliary reservoir 47. The motor control unit 50 projects beyond the auxiliary reservoir 47 in a cantilevered fashion. The cooling ribs 71 are surrounded by an air guide housing 72 provided with a plurality of openings containing fans 73 for blowing cooling air into the air guide housing. The cooling air is discharged through openings 74.

Although a preferred embodiment of the invention has been specifically illustrated and described herein, it is to be understood that minor variations may be made in the apparatus without departing from the spirit and scope of the invention, as defined by the appended claims.

What is claimed is:

1. A hydraulic unit comprising an oil-containing reservoir (28) including a motor (15) and a multiple piston pump (60) driven by said motor, said multiple piston pump (60) having a plurality of individual pumps (61) evenly spaced around a motor shift axis in a star-shaped array, wherein said reservoir (28) has connected therewith an at least partly oil-filled auxiliary reservoir (47) for refilling said reservoir after withdrawal of oil by said multiple piston pump, thus ensuring a complete submersion of said multiple piston pump (60), said oil defining an oil level (65) within the auxiliary reservoir (47), the auxiliary reservoir (47) being hermetically sealed above the oil level (65), and below said oil level (65) a connecting line (48) connecting the auxiliary reservoir with a vented additional tank (45).

2. The hydraulic unit according to claim 1, wherein the reservoir (28) has a cross section where the width of the reservoir narrows towards the upper end.

3. The hydraulic unit according to claim 2, wherein the reservoir (28) has a substantially round cross section.

4. The hydraulic unit according to claim 1, wherein the auxiliary reservoir (47) is arranged on top of the reservoir (28).

5. The hydraulic unit according to claim 1, wherein the auxiliary reservoir (47) comprises a ventilation opening above a maximum oil level (65).

6. The hydraulic unit according to claim 1, wherein the housing (10) comprises on its outside ribs (12) extending in the axial direction of the motor (15), and that at one end of the housing a fan (30) is provided which radially projects beyond the housing and produces a cooling air flow (32) along said ribs (12).

7. The hydraulic unit according to claim 6, wherein the housing (10) is composed of a profile body whose ends are closed by front walls.

8. The hydraulic unit according to claim 1, wherein the housing (10) is composed of a profile body whose ends are closed by front walls.

9. A hydraulic unit comprising an oil-containing reservoir (28) including a motor (15) and a multiple piston pump (60) driven by said motor, said multiple piston pump (60) having a plurality of individual pumps (61) evenly spaced around a motor shift axis in a star-shaped array, wherein said reservoir (28) has connected therewith an at least partly oil-filled auxiliary reservoir (47) for refilling said reservoir after withdrawal of oil by said multiple piston pump, thus ensuring a complete submersion of said multiple piston pump (60), said oil defining an oil level (65) within the auxiliary reservoir (47), the reservoir (28) comprising a housing (10) which also defines the housing of the motor (15), wherein the motor (15) comprises a rotor (17) and the rotor (17) of the motor is surrounded by the oil, the housing (10) comprising means for fastening an additional tank (45) which is connectable with the auxiliary reservoir (47) by a connecting line (48).

10. The hydraulic unit according to claim 9, wherein a plurality of additional tanks (45*a*) of different sizes are attachable to the housing (10).

11. A hydraulic unit comprising an oil-containing reservoir (28) including a motor (15) and a multiple piston pump (60) driven by said motor, said multiple piston pump (60) having a plurality of individual pumps (61) evenly spaced around a motor shift axis in a star-shaped array, wherein said reservoir (28) has connected therewith an at least partly oil-filled auxiliary reservoir (47) for refilling said reservoir after withdrawal of oil by said multiple piston pump, thus ensuring a complete submersion of said multiple piston pump (60), said oil defining an oil level (65) within the auxiliary reservoir (47), the reservoir (28) comprising a housing (10) which also defines the housing of the motor (15), wherein the motor (15) comprises a rotor (17) and the rotor (17) of the motor is surrounded by the oil, the housing (10) comprises on its outside ribs (12) extending in the axial direction of the motor (15), and that at one end of the housing a fan (30) is provided which radially projects beyond the housing and produces a cooling air flow (32) along said ribs (12), the housing (10) comprising means for fastening an additional tank (45) which is connectable with the auxiliary reservoir (47) by a connecting line (48).

12. A hydraulic unit comprising an oil-containing reservoir (28) including a motor (15) and a multiple piston pump (60) driven by said motor, said multiple piston pump (60) having a plurality of individual pumps (61) evenly spaced around a motor shift axis in a star-shaped array, wherein said reservoir (28) has connected therewith an at least partly oil-filled auxiliary reservoir (47) for refilling said reservoir after withdrawal of oil by said multiple piston pump, thus ensuring a complete submersion of said multiple piston pump (60), said oil defining an oil level (65) within the auxiliary reservoir (47), the reservoir (28) comprising a housing (10) which also defines the housing of the motor (15), wherein the motor (15) comprises a rotor (17) and the rotor (17) of the motor is surrounded by the oil, the housing (10) is composed of a profile body whose ends are closed by front walls, the housing (10) comprising means for fastening an additional tank (45) which is connectable with the auxiliary reservoir (47) by a connecting line (48).

13. A hydraulic unit comprising an oil-containing reservoir (28) including a motor (15) and a multiple piston pump (60) driven by said motor, said multiple piston pump (60) having a plurality of individual pumps (61) evenly spaced around a motor shaft axis in a star-shaped array, wherein each individual pump (61) is a piston pump and wherein the reservoir (28) comprises a housing (10) which also defines the housing of the motor (15) and of the multiple piston pump (60), wherein said reservoir (28) has connected therewith an at least partly oil-filled auxiliary reservoir (47) for refilling said reservoir after withdrawal of oil by said multiple piston pump, thus ensuring a complete submersion of said multiple piston pump (60), said oil defining an oil level (65) within the auxiliary reservoir (47) the auxiliary reservoir (47) being hermetically sealed above the oil level (65), and below said oil level (65) a connecting line (48) connecting the auxiliary reservoir with a vented additional tank (45).

14. The hydraulic unit according to claim 13, wherein the reservoir (28) has a cross section where the width of the reservoir narrows towards the upper end.

15. The hydraulic unit according to claim 14, wherein the reservoir (28) has a substantially round cross section.

16. The hydraulic unit according to claim 13, wherein the auxiliary reservoir (47) is arranged on top of the reservoir (28).

17. The hydraulic unit according to claim 13, wherein the auxiliary reservoir (47) comprises a ventilation opening above a maximum oil level (65).

18. The hydraulic unit according to claim 13, wherein the housing (10) comprises on its outside ribs (12) extending in the axial direction of the motor (15), and that at one end of the housing a fan (30) is provided which radially projects beyond the housing and produces a cooling air flow (32) along said ribs (12).

19. The hydraulic unit according to claim 13, wherein the housing (10) is composed of a profile body whose ends are closed by front walls.

20. A hydraulic unit comprising an oil-containing reservoir (28) including a motor (15) and a multiple piston pump (60) driven by said motor, said multiple piston pump (60) having a plurality of individual pumps (61) evenly spaced around a motor shaft axis in a star-shaped array, wherein each individual pump (61) is a piston pump and wherein the reservoir (28) comprises a housing (10) which also defines the housing of the motor (15) and of the multiple piston pump (60), wherein said reservoir (28) has connected therewith an at least partly oil-filled auxiliary reservoir (47) for refilling said reservoir after withdrawal of oil by said multiple piston pump, thus ensuring a complete submersion of said multiple piston pump (60), said oil defining an oil level (65) within the auxiliary reservoir (47), the motor (15) comprising a rotor (17) and the rotor (17) of the motor being surrounded by the oil, the housing (10) comprising means for fastening an additional tank (45) which is connectable with the auxiliary reservoir (47) by a connecting line (48), and a plurality of additional tanks (45) of different sizes being attached to the housing (10).

* * * * *